US005572762A

United States Patent [19]

Scheiner

[11] Patent Number: 5,572,762

[45] Date of Patent: Nov. 12, 1996

[54] TOOTHBRUSH WITH SOUND GENERATOR

[76] Inventor: Jonathan Scheiner, 241 Muer Dago Rd., Topanga, Calif. 90290

[21] Appl. No.: 241,737

[22] Filed: May 12, 1994

[51] Int. Cl.[6] ..... A46B 9/04

[52] U.S. Cl. ..... 15/105; 15/167.1; 84/94.2; 434/263; 446/404

[58] Field of Search ..... 15/105, 167.1, 15/DIG. 1; 84/94.2; 434/263; 446/71, 81, 302, 303, 404

[56] References Cited

U.S. PATENT DOCUMENTS

| | | | |
|---|---|---|---|
| 2,800,825 | 7/1957 | Toussaint | 84/94.2 |
| 3,685,080 | 1/1972 | Hubner | 15/22.1 |
| 4,665,921 | 5/1987 | Teranishi et al. | 15/167.1 |
| 4,779,173 | 10/1988 | Carr et al. | 15/105 |
| 4,788,734 | 12/1988 | Bauer | 434/263 |
| 4,866,807 | 9/1989 | Kreit et al. | 15/105 |
| 5,044,037 | 9/1991 | Brown | 15/105 |
| 5,133,102 | 7/1992 | Sakuma | 15/167.1 |
| 5,259,086 | 11/1993 | Fong | 15/105 |
| 5,339,479 | 8/1994 | Lyman | 15/105 |

FOREIGN PATENT DOCUMENTS

| | | | |
|---|---|---|---|
| 3149233 | 4/1983 | Germany | 15/105 |
| 3309687 | 9/1984 | Germany | 15/105 |
| 101490 | 4/1990 | Japan | 434/263 |

*Primary Examiner*—Mark Spisich
*Attorney, Agent, or Firm*—Loeb & Loeb LLP

[57] ABSTRACT

A sound generating toothbrush has a sound generating apparatus and a switch device for activating the sound generating apparatus. The toothbrush has a handle portion with a compartment provided adjacent to the proximate end thereof for accommodating the sound generating apparatus and the switch device. The switch device has a bush-button which is located at the proximate end of the handle. Consequently, the sound generating apparatus can be activated, while normally holding the handle portion of the toothbrush, by momentarily pressing the proximate end of the toothbrush handle against any appropriate surface.

21 Claims, 6 Drawing Sheets

TOOTHBRUSH WITH SOUND GENERATOR

BACKGROUND OF THE INVENTION

1. Field of the Invention

The present invention relates generally to sound generating toothbrushes, and in particular embodiments, to toothbrushes having sound generating devices controlled by user activated timers.

2. Description of Related Art

In recent years various advancements have been made in toothbrush designs in an effort to increase brushing effectiveness and to promote better dental care. A variety of toothbrushes with audible sound generating devices have been developed to encourage better brushing practices. Some sound generating devices play musical tunes to accompany users when brushing. Other sound generating devices provide brushing instructions while the user brushes his or her teeth.

An example of a sound generating toothbrush is described in U.S. Pat. No. 4,788,734 to Bauer ("the '734 patent"). The toothbrush described in the '734 patent has a handle 2 with an expanded central portion configured to permanently house a chip 3, a battery 4, a sound generator 5, an amplifier 6 and a capacitive or inductive switch 7. The expanded portion of the handle for housing these components is centrally located along the length of the handle 2, in a location such that a user's hand would cover (and, thus, activate) the switch 7 merely by holding the toothbrush handle in an ordinary brushing grip.

However, because toothbrushes are periodically disposed of and replaced (many dentists recommend such replacement every three to six months), the electrical components permanently housed within the handle must be suitable for such periodic disposal and replacement. In this regard, such electronic components tend to be relatively inexpensive and thus, of relatively low quality. Such low quality devices tend to produce low quality sound reproductions which can be annoying to the user and may dissuade the user from using the toothbrush. In addition, a user desiring to hold the toothbrush handle with an ordinary brushing grip has no choice but to activate the sound generator—the switch 7 is located so as to automatically activate the sound generator when the handle is held with an ordinary brushing grip. This can be annoying to those users who desire to brush from time-to-time without musical accompaniment. Furthermore, because the handle has an expanded central portion for housing the electrical components, it is not likely that the expanded handle portion will fit within a standard sized toothbrush handle slot in a standard toothbrush holder.

Other sound generating toothbrush devices have been provided with a housing containing sound generating circuitry, wherein the housing is removably attached to the end of a toothbrush handle. Examples of such are described in U.S. Pat. No. 4,866,807 to Kreit et al., U.S. Pat. No. 4,341,230 to Siahou and U.S. Pat. No. 5,259,086 to Fong. An example of a toothbrush device with a sound generator housing permanently attached to the end of a toothbrush handle is described in U.S. Pat. No. 5,044,037 to Brown. However, the sound generator housings described in these patents form relatively large appending members at the end of the toothbrush handle. Such housings tend to be cumbersome and obstructive, often making it difficult to grip and control the toothbrush handle. In addition, when such sound generator housings are attached to the toothbrush handles, the toothbrush may not fit in standard slot-type toothbrush holders (which typically have a shaped slot through which the toothbrush handle is inserted). In addition, some prior art devices employ sound generating equipment for generating musical tunes or recorded messages and which require relatively expensive and high quality sound generators, memory devices and speakers. Such devices typically require relatively large housings for the sound generating equipment which, as noted above, tends to result in oversized toothbrush handles which do not fit in standard slots formed in standard toothbrush holders.

Moreover, the sound generators employed in the toothbrush devices described in the above-cited patents are activated by switches located at or adjacent the location at which the devices are typically gripped during brushing. In this regard, a user is likely to inadvertently activate the sound generator when brushing. This can become annoying to users who desire not to activate the sound generator or to users who inadvertently activate the sound generator several times during a brushing session.

Thus, there is a need in the industry for a toothbrush with a sound generator that is readily activated when desired, but not easily activated inadvertently during brushing. There is also a need in the industry for such a toothbrush which can be economically disposed of and replaced. There is also a need in the industry for such a toothbrush which can be readily gripped and controlled by a user employing an ordinary toothbrushing grip. There is a further need in the industry for a toothbrush which employs an economical, relatively simple sound generating device (e.g., for generating simple sounds, such as short beeps) that requires only a small amount of space. There is also a need in the industry for such a toothbrush which is configured so as to fit within the standard shaped handle slot of typical toothbrush holders.

SUMMARY OF THE DISCLOSURE

It is an object of embodiments of the present invention to provide a toothbrush with a sound generating apparatus which addresses at least some of the above-noted needs of the industry.

These objects, as well as others, are achieved, according to embodiments of the present invention, in a sound generating toothbrush having a sound generating apparatus and a switch device for activating the sound generating apparatus. In the illustrated embodiment, the toothbrush has a handle portion with a compartment provided adjacent to the proximate end thereof for accommodating therein the sound generating apparatus and the switch device. As will be discussed in greater detail below, the switch device has a push-button which is located at the proximate end of the handle. Consequently, the sound generating apparatus can be activated, while normally holding the handle portion of the toothbrush, by hitting the proximate end of the toothbrush handle at any appropriate surface. As a result, false activations of the sound generating apparatus are substantially eliminated.

These and other objects and advantages will be made more clear in connection with the following description of the drawings.

DETAILED DESCRIPTION OF THE DRAWINGS

The following detailed description is of the best presently contemplated mode of carrying out the invention. This description is not to be taken in a limiting sense, but is made merely for the purpose of illustrating the general principles of embodiments of the invention. The scope of the invention is best defined by the appended claims.

A sound generating toothbrush in accordance with one embodiment of the present invention is shown generally at 10. The sound generating toothbrush 10 includes a handle part 12 and a bristle part 14. A set of bristles 16 is supported by the bristle part 14. Preferably, the handle part 12 has a general peripheral shape and dimension of a the handle part of a standard toothbrush. Embodiments may include, angled, bent or flexible handle parts or other suitable handle configuration.

Figure 8:
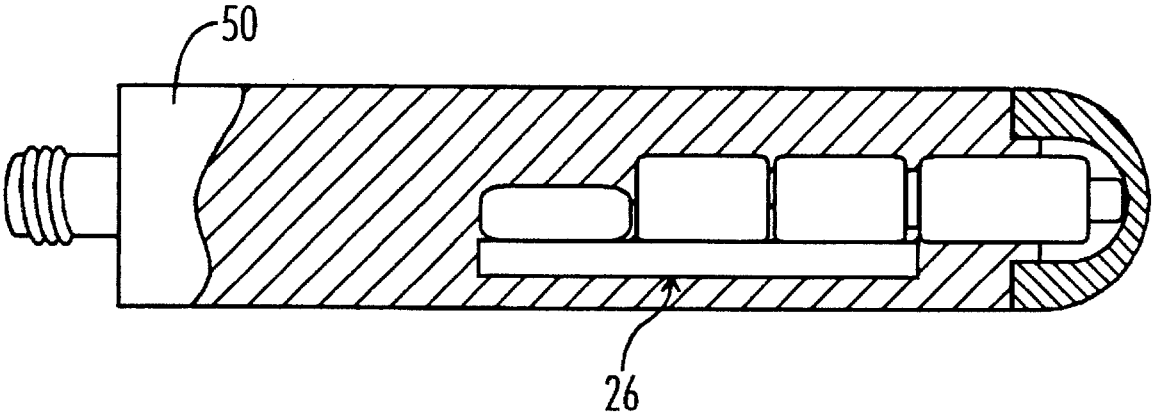
FIG. 8 is a cut away view of the handle end portion of the toothbrush embodiment of FIG. 7 in which a sound generating module is molded within the handle end portion.

In the illustrated embodiment, the handle part 12 has a compartment 18 provided adjacent to its free end 20. The compartment 18 has a top opening 22 and an end opening 24 and a hollow interior for housing therein an electronic module 26. In another embodiment, the compartment 18 may be provided in the form of a cylindrical bore (not shown) drilled, casted or otherwise provided in the handle part 12. In further embodiment, the electronic module 26 may be inserted during the handle molding process and, thereby, be molded into the handle part 50, as shown in FIG. 8.

Figure 5:
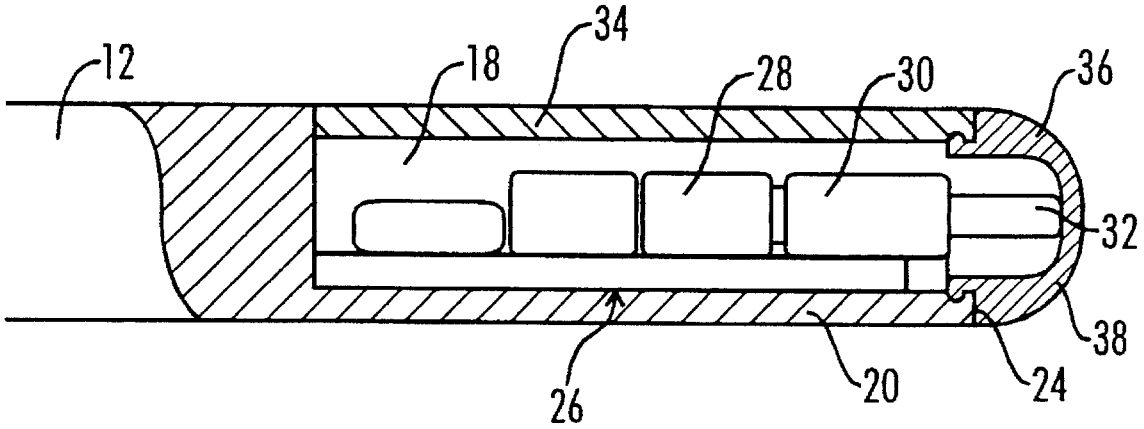
FIG. 5 is a cut away view of the handle end portion of the toothbrush embodiment of FIG. 1 in accordance with one embodiment of the present invention.
Figure 6:
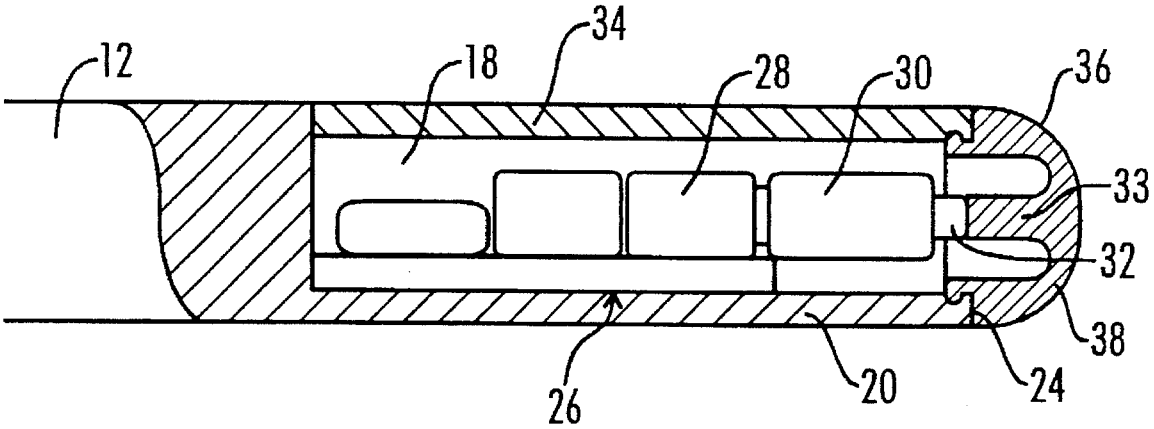
FIG. 6 is a cut away view of the handle end portion of the toothbrush embodiment of FIG. 1 in accordance with another embodiment of the present invention.

As will be described in greater detail below, the electronic module 26 includes a timer device 28 and a switch device 30 coupled to the timer device 28. In a preferred embodiment, the switch device 30 is a pressure sensitive switch and includes a push-button 32 configured to be disposed adjacent to the open end 24 of the handle part 12. In one embodiment, as shown in FIG. 5, the push-button 32 is positioned to protrude from the end opening 24 and is directed outward from the end 20 of the handle part 12 along the longitudinal axis of the handle part 12, so that the push-button 32 may be depressed in the direction of the longitudinal axis of the handle part 12. In further embodiments, as shown in FIG. 6, the push-button 32 is recessed with respect to end 20 of the handle part. In such embodiments, an extension member (e.g., formed as part of the membrane 38 discussed below, or provided as a separate element) may be disposed adjacent the recessed push-button 32 so as to extend from the end 20 so as to transfer an applied force to the recessed push-button for actuating the push-button. In yet further embodiments, other switches, such as capacitive switches, inductive switches, heat sensitive switches or the like, may be used as an alternative to the push-button switch discussed above.

The compartment 18 containing the electronic module 26 is closed with a top cover 34 and an end cover 36. In case of the cylindrical bore-type compartment, only an end cover may be required to close the compartment. In preferred embodiments, the covers provide a suitable seal to inhibit moisture from entering the compartment 18. In further preferred embodiments, the covers and the electronic module 26 are removable from the handle part 12, to allow the handle part 12, bristle part 14 and bristles 16 to be disposed of, as a single unit, without disposing of the electronic module. For example, the cover 34 may be removably snap fitted or friction fitted to the rest of the handle part 12, over the interior of the compartment 18. Thus, a user may readily remove the electronic module 26 from a used and worn handle and bristle unit and replace electronic module in the compartment 18 of a new handle and bristle unit. In this manner, the electronic module 26 need not be disposed of when disposing the used and worn handle and bristle unit. The cost of replacing ones toothbrush can, thereby be minimized.

In accordance with embodiments of the present invention, the end cover 36 may be formed using a compliant sheet material, such as for example, a membrane 38 for covering the push-button 32 so that the push-button 32 is activated by external pressure applied against the membrane 38.

Figure 1:
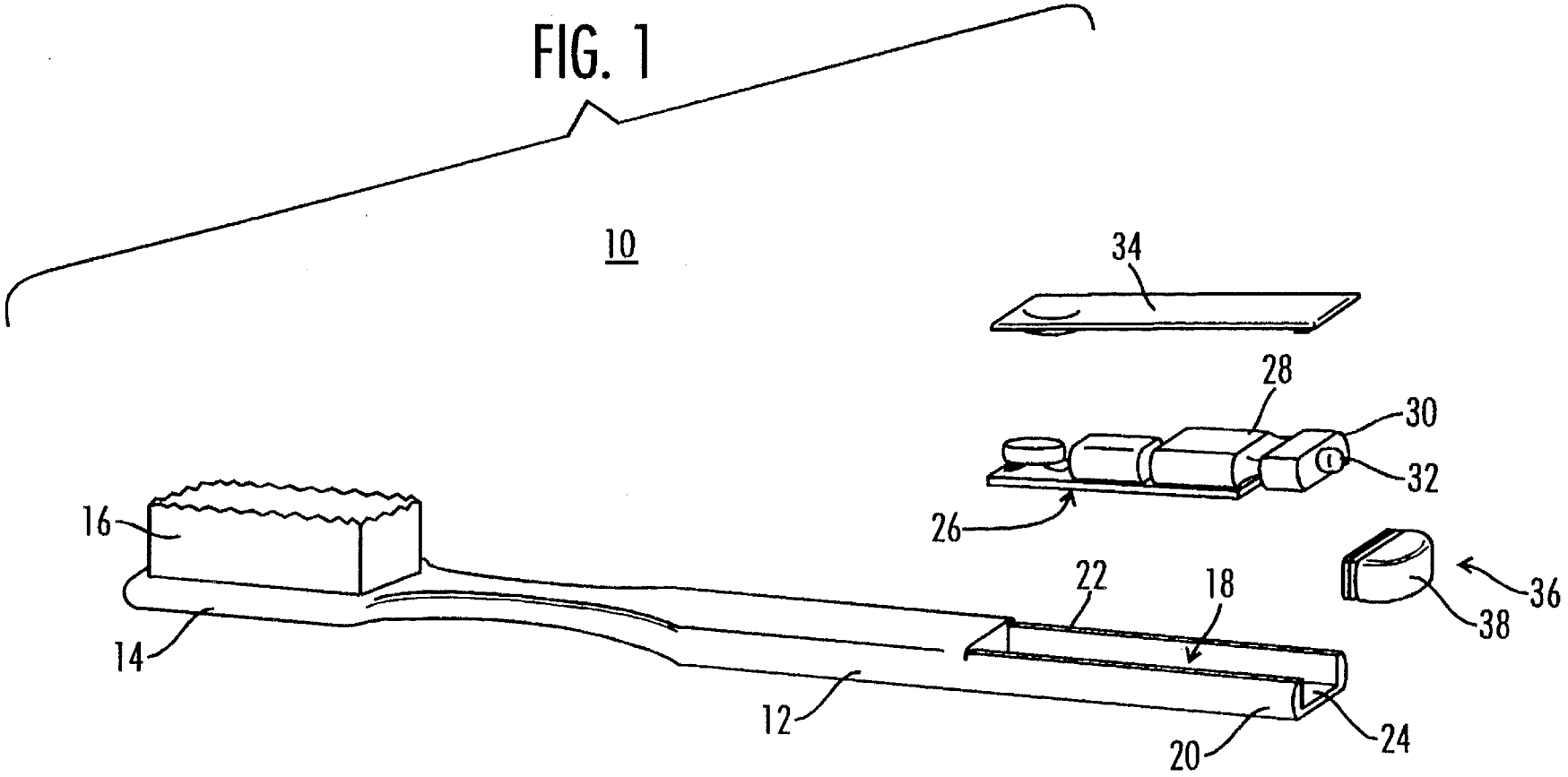
FIG. 1 is an exploded view of a toothbrush with a sound generating apparatus in accordance with one embodiment of the present invention.
Figure 2:
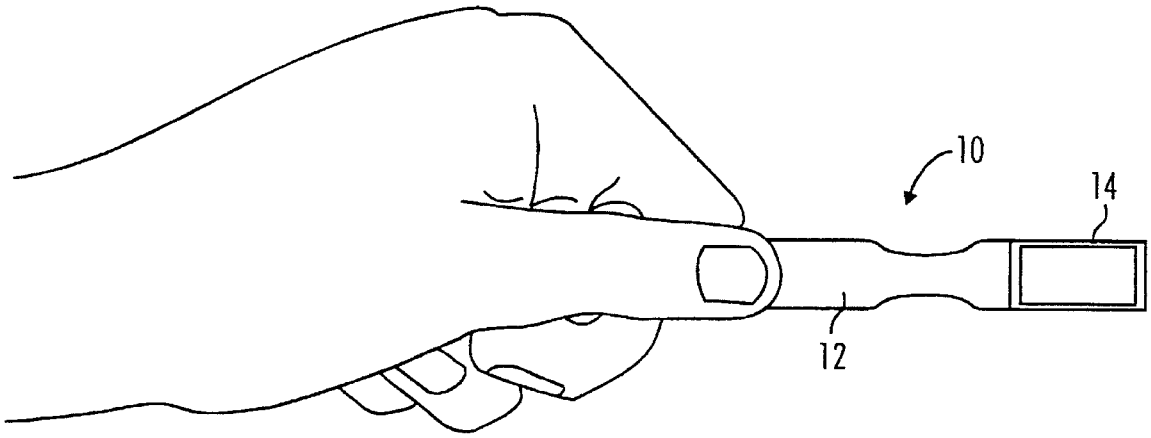
FIG. 2 is a perspective view of the toothbrush embodiment of FIG. 1 being held in an ordinary brushing grip.

When the electronic module 26 is closed within the compartment 18 by the covers 34 and 36, the toothbrush preferably resembles (in external appearance) a standard toothbrush. The toothbrush, thus, may be held by a user with an ordinary brushing grip, as shown in FIG. 2, for a typical brushing procedure. In addition, the toothbrush preferably has the general dimensions of a standard toothbrush and, thus, will fit within standard size toothbrush slots in standard toothbrush holders.

Figure 3:
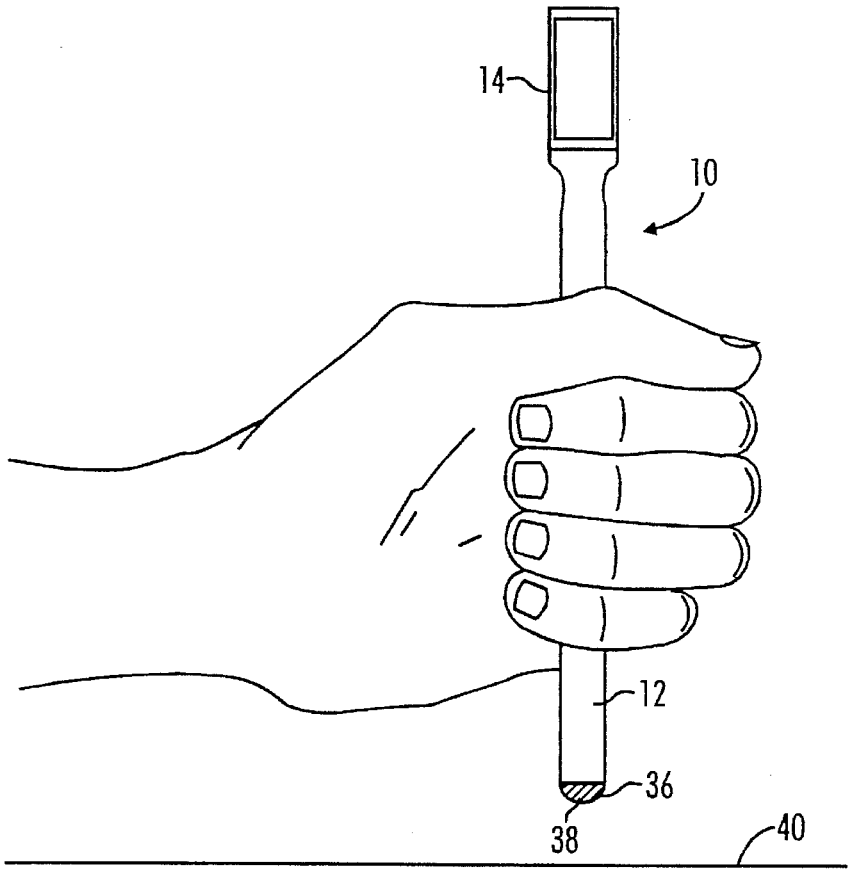
FIG. 3 is a perspective view of the toothbrush embodiment of FIG. 1 being switched on by the user.

At any desired time (preferably just prior to applying the toothpaste to the bristles or just prior to applying the bristles to the users teeth) the user may activate the switch 32 by directing the end 20 of the handle portion 12 toward a surface 40 (such as the surface of a vanity counter top or another suitable surface) and engaging the membrane 38 with the surface 40, as best shown in FIG. 3. In this manner, the portion of the membrane 38 at the end of the handle part 12 may be readily tapped or pressed against the surface 40 to activate the sound generating device 28. However, because the membrane 38 and switch 32 extend from the distal end of the toothbrush and are activated by pressure applied in the axial direction of the handle part 12, the membrane and switch are not readily activated inadvertently by the users thumb, fingers or palm when the handle portion 12 is held with an ordinary brushing grip as shown in FIG. 2.

Figure 4:
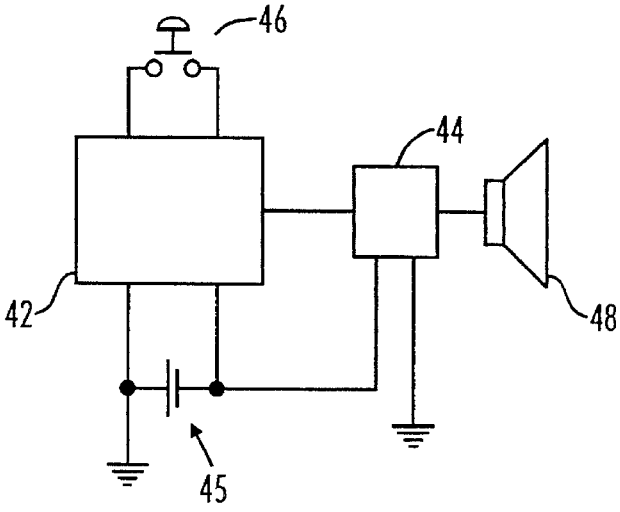
FIG. 4 is a circuit diagram of an embodiment of the electronic module of the sound generating apparatus shown in FIG. 1.

As shown in FIG. 4, the module 26 comprises a timer circuit 42 and a sound generator 44. The timer circuit 42 is activated by a switch mechanism 46. A power source 45 provides power to the timer circuit 42 and the sound generator 44. Because the space of the compartment 18 is limited, a small power source such as for example, a single cell 3 volt lithium battery may preferably be used. The sound generator 44 is connected to a loudspeaker or buzzer 48.

In one embodiment, the sound generator 44 may comprise a digital sound generator (not shown) for playing tunes and/or a digital voice synthesizer (not shown) for issuing cleaning instructions for a period of time controlled by the timer circuit 42. In preferred embodiments, however, the timer circuit 42 is directly coupled to the buzzer 48 (or other economical, small size sound generator) for providing relatively simple buzzer or beep sounds at the end of (or at the beginning and end of) a predetermined period of time, such as a period of time recommended for proper brushing. By employing relatively simple sound generating equipment (e.g., buzzers or beepers) as opposed to the more complex tune playing recording or voice synthesizing devices, the overall cost and size of the sound generating equipment (and the toothbrush) may be minimized. Minimization of the size of the sound generating equipment is especially beneficial for designing toothbrush handles to fit within standard toothbrush holder slots.

Figure 9:
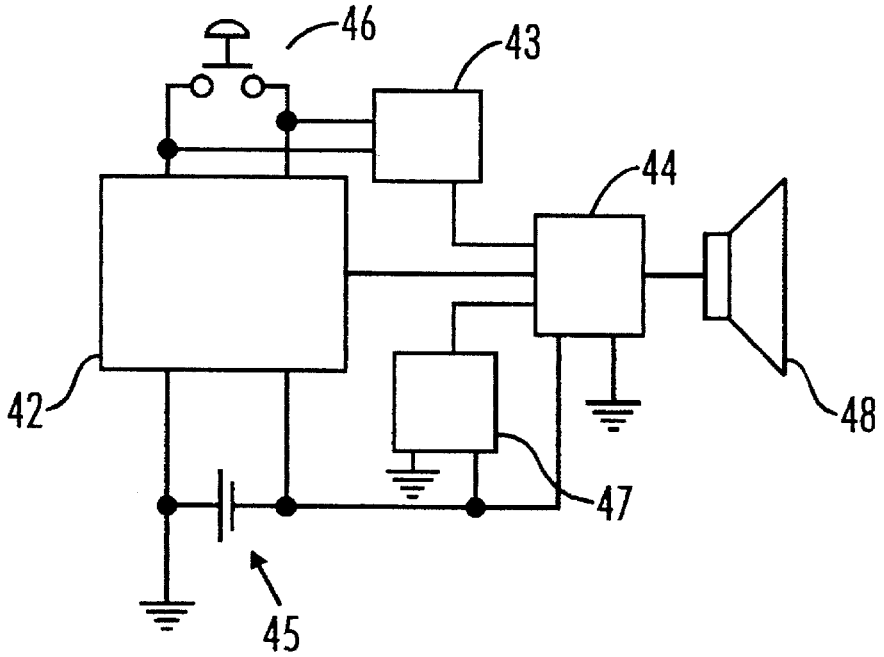
FIG. 9 is another embodiment of a circuit diagram of the electronic module of the sound generating apparatus in FIG. 1.

In a further embodiment, the timer circuit 42 may include a counter 43 (as shown in FIG. 9) for counting the number of activations of the timer circuit 42, which may represent the number of times the toothbrush has been used. The timer circuit 42 may include a suitable alarm to provide a user perceivable signal (e.g, an audible signal or, alternatively a visible signal, such as an LED indicator, not shown) after a predetermined number of timer circuit activations have occurred. The predetermined number may be chosen to provide the user with an indication that the handle and bristle unit of the toothbrush should be replaced with a new handle and bristle unit. In a further embodiment, the module 26 includes a battery life monitor 47 (as shown in FIG. 9) for monitoring the power storage status of the battery and for providing an indication (e.g., audio beeps or other audio or visual signals) when the battery power level reaches a predetermined minimum.

Figure 7:
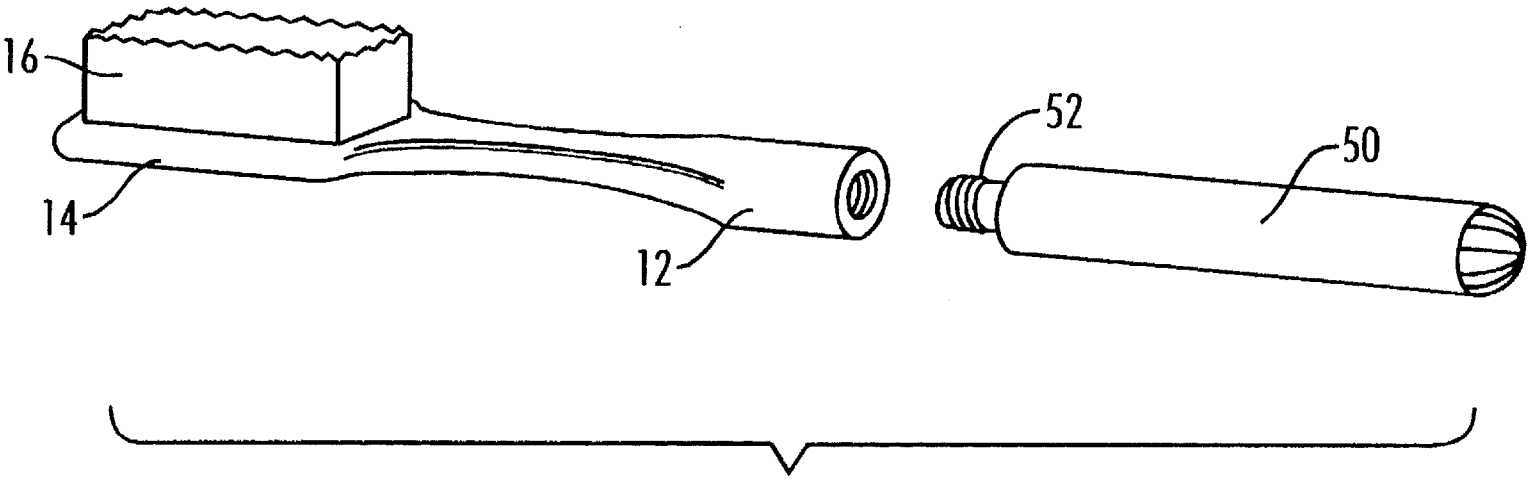
FIG. 7 is an exploded view of a toothbrush having an independent housing for housing a sound generating module which is separable from a handle part of a toothbrush in accordance with another embodiment of the present invention.

It will, of course, be understood that modifications of the present invention, in its various aspects will be apparent to those skilled in the art, some being apparent only after study and others being matters of routine mechanical designs. For example, in further embodiments, as shown in FIG. 7, the module 26 may be housed in a housing which is provided independently of the handle part 12. The housing may include a connector 52 for connecting the housing to the free end of the handle part 12. The push-button 32 may be provided at the extreme end of the housing and is positioned to protrude from the extreme end of the housing so that the push-button 32 may be pressed in a similar manner as described in the illustrated embodiment with reference to FIG. 3.

Therefore, the presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

What is claimed is:

1. A toothbrush comprising:

an elongated handle having a first end, a second end opposed to the first end, and an axial direction extending from the first end to the second end, the handle having a compartment within the handle, the compartment having an opening at the first end of the handle;

a set of bristles provided adjacent to the second end of the handle;

a sound generating device provided within the compartment adjacent to the first end of the handle; and switch mechanism coupled to the sound generating device for selectively activating the sound generating device, the switch mechanism being disposed at the opening at the first end of the handle, the switch mechanism having at least a portion which extends through the opening and beyond the first end of the handle and which is moveable in the axial direction of the handle to activate the sound generating device.

2. A toothbrush according to claim 1, wherein the switch mechanism comprises an electronic switch member and a water impermeable membrane covering the electronic switch member to prevent water damage to the sound generating device and the electronic switch member.

3. A toothbrush according to claim 1, wherein the switch mechanism has a moveable push-button which is moveable in the axial direction of the elongated handle for activation of the sound generating device and wherein the push-button is positioned to protrude from the first end of the handle.

4. A toothbrush according to claim 3, wherein the compartment receiving at least a portion of the switch mechanism therein.

5. A toothbrush according to claim 4 further comprising a water impermeable membrane covering the push-button to prevent water damage to the sound generating device and the switch mechanism.

6. A toothbrush according to claim 1, wherein the sound generating device comprises an electrical circuit for generating musical sounds and a timer device for activating the electrical circuit to generate musical sounds for a predetermined time period.

7. A toothbrush according to claim 6, wherein the switch mechanism having a push-button protruding from the first end of the handle for activating the sound generating device.

8. A toothbrush according to claim 1, wherein the sound generating device comprises an electrical circuit for generating audible signals and a timer device for activating the electrical circuit to generate an audible signal at the beginning and the expiration of a predetermined time period.

9. A toothbrush according to claim 8, wherein the switch mechanism having a push-button protruding from the first end of the handle for activating the sound generating device.

10. A toothbrush according to claim 1, further comprising a depletable power source for providing electrical power to the sound generating device and a power source monitor for monitoring the depletion state of the power source and for providing a signal upon the power source reaching a predetermined depletion state.

11. A toothbrush according to claim 10, wherein the switch mechanism having a push-button protruding from the first end of the handle for activating the sound generating device.

12. A toothbrush according to claim 1, wherein the sound generating device is molded into the handle as a mold insert.

13. A toothbrush according to claim 12, wherein the switch mechanism having a push-button protruding from the first end of the handle for activating the sound generating device.

14. A toothbrush according to claim 1, wherein the switch mechanism having a push-button protruding from the first end of the handle for activating the sound generating device.

15. A toothbrush according to claim 1, wherein the toothbrush being shaped to be held by a toothbrush holder having at least one slot, the toothbrush having a cross-section sized to fit through a slot of the toothbrush holder.

16. A toothbrush according to claim 1, wherein the switch mechanism includes an electronic switch actuable to activate the sound generating device and wherein the portion of the switch mechanism that extends through the opening and beyond the first end of the handle comprises an extension member moveable in the axial direction of the handle and coupled to actuate the electronic switch upon movement in the axial direction of the handle.

17. A toothbrush comprising:

an elongated handle having a first end and a second end opposed to the first end, the handle having a longitudinal axis and a compartment within the handle, the compartment defining an opening at the first end of the handle;

a set of bristles provided adjacent to the second end of the handle;

a sound generating device provided within the compartment adjacent to the first end of the handle;

switch coupled to the sound generating device for selectively activating the sound generating device, the switch being disposed adjacent the opening at the first end of the handle, the switch having a moveable switch member moveable in the direction of the longitudinal axis of the handle for activation of the sound generating device, the moveable switch member being recessed from the first end of the handle; and a water impermeable membrane covering the moveable switch member to prevent water damage to the sound generating device and the switch, and an extension member extending from the impermeable membrane for connecting the impermeable membrane and the moveable switch member.

18. A toothbrush according to claim 17, wherein the water impermeable membrane and the extension member form a unitary, single-piece structure.

19. A toothbrush comprising:

an elongated handle having a first end and a second end opposed to the first end, the handle having a compartment within the handle, the compartment defining an opening at the first end of the handle;

a set of bristles provided adjacent to the second end of the handle;

a sound generating device provided within the compartment adjacent to the first end of the handle;

switch coupled to the sound generating device for selectively activating the sound generating device, the switch being disposed adjacent the opening at the first end of the handle, the switch having a push-button positioned to be recessed from the first end of the handle, the compartment receiving at least a portion of the switch therein; and a water impermeable membrane covering the pushbutton to prevent water damage to the sound generating device and the switch, and an extension member extending from the impermeable membrane for connecting the impermeable membrane and the pushbutton.

20. A toothbrush comprising:

an elongated handle having a first end and a second end opposed to the first end, the handle having a compartment within the handle, the compartment defining an opening at the first end of the handle;

a set of bristles provided adjacent to the second end of the handle;

a sound generating device provided within the compartment adjacent to the first end of the handle; and switch coupled to the sound generating device for selectively activating the sound generating device, the switch being disposed adjacent the opening at the first end of the handle; wherein the sound generating device comprises an electrical circuit for generating audible signals and a counter device for counting the number of activations of the switch and for activating the electrical circuit to generate an audible signal upon the number of activations counted by the counter reaching a predetermined count number.

21. An audible sounds generating apparatus to be connected to a handle of a toothbrush, the toothbrush handle defining an axial direction along the length of the handle, the audible sounds generating apparatus comprising:

a housing having a first end and a second end opposed to the first end;

connecting means provided at the first end of the housing for connecting to the handle of the toothbrush;

sound generating means provided within the housing for generating an audible sound; and a switch device coupled to the sound generating means and having a push-button moveable in the axial direction of the handle for activating the sound generating means;

wherein the housing defines an opening at the second end thereof for accessing the switch device, and the pushbutton having at least a portion extending through the opening and beyond the second end of the housing.

* * * * *